US005185623A

United States Patent [19]

Mogi

[11] Patent Number: 5,185,623

[45] Date of Patent: Feb. 9, 1993

[54] APPARATUS FOR TREATING A PHOTOSENSITIVE MATERIAL AND METHOD OF ADDING WATER FOR USE IN THE SAME

[75] Inventor: Fumio Mogi, Kanagawa, Japan

[73] Assignee: Fuji Photo Film Co., Ltd., Kanagawa, Japan

[21] Appl. No.: 694,736

[22] Filed: May 2, 1991

[30] Foreign Application Priority Data

May 8, 1990 [JP] Japan ..... 2-117972

[51] Int. Cl.[5] ..... G03D 13/00

[52] U.S. Cl. ..... 354/299; 354/324

[58] Field of Search ..... 354/324, 299, 323, 322

[56] References Cited

FOREIGN PATENT DOCUMENTS 1-254959 10/1989 Japan .
1-254960 10/1989 Japan .
1-281446 11/1989 Japan .

*Primary Examiner*—Michael L. Gellner
*Assistant Examiner*—D. Rutledge
*Attorney, Agent, or Firm*—Sughrue, Mion, Zinn, Macpeak & Seas

[57] ABSTRACT

According to the present invention, there is disclosed an apparatus for treating a photosensitive material comprising a treating solution tank storing a treating solution for treating the photosensitive material, a replenishing unit for replenishing the solution into the treating solution tank and a water adding unit for adding water into the treating solution tank, in which an overflow sensor is provided to sense an overflow of the treating solution out of the treating solution tank based on the difference in the thermal conductivity of the surrounding environment as observed while the overflow is taking place and while the same is not taking place, and a predetermined amount of the solution is intermittently added by a constant amount to evaluate an entire amount of the solution replenished until it overflows out of the treating solution tank so that a corresponding amount of water may be added by the water adding unit. Therefore, the actual evaporation loss may precisely be compensated with water.

19 Claims, 7 Drawing Sheets

APPARATUS FOR TREATING A PHOTOSENSITIVE MATERIAL AND METHOD OF ADDING WATER FOR USE IN THE SAME

BACKGROUND OF THE INVENTION a) Field of the Invention

The present invention relates to an apparatus for treating a photosensitive material and a method of adding water into the same apparatus, in which the concentration of a treating solution stored within a treating tank of the apparatus is held constant.

b) Description of the Prior Art

In an automatic developing machine, which forms part of the apparatus for treating the photosensitive material, a developing tank, bleaching tank, fixing tank, rinsing tank and a stabilizing tank are provided each storing a developing solution, bleaching solution, fixing solution, rinsing solution and a stabilizing solution (hereinafter generally referred to as a treating solution). The photosensitive material, which has been subjected to a stoving treatment, is sequentially immersed into each of the treating tanks and, after being developed, it is introduced into a drying unit, where it is dried prior to being withdrawn.

The treating solution deteriorates depending on the throughput of the photosensitive material. In order to recover the treating solution that has deteriorated, a solution is added into the treating tank and a corresponding amount is overflowingly delivered out of the treating tank as a waste solution. Such an amount of the treating solution to be replenished as it deteriorates can be readily calculated from the throughput of the photosensitive material. Meanwhile, referring to the evaporation loss of the treating solution, since only the water content within the treating solution is decreased, the concentration of the treating solution can be changed. Therefore, it is necessary to add an amount to of water corresponding to the evaporation loss independently of the replenished solution. However, since the evaporation loss varies with the changing of the surrounding environment, that is, the temperature or humidity or also depending on whether the apparatus is operating or shut down, it cannot uniquely be determined by calculation.

Therefore, it is proposed to immerse a concentration sensor, such as a hygrometer or the like, within the treating solution of each treating tank to add water based on a value sensed by the sensor. (See, for example, Japanese Patent Application Laid-Open No. 1-281446), in which change of the concentration of the treating solution can be recognized by the sensor so that an appropriate amount of water may be added into the treating tank.

Nevertheless, the operating reliability of the concentration sensor is low and it can often erroneously operate due to precipitation of the treating solution, which makes it impossible to add the appropriate amount of water. This can be also said of a level sensor such as a float or the like. In addition, the concentration sensor and level sensor are costly and lack practical usability. Thus, it is proposed to provide a monitoring tank independently of the actual treating tank and add water into the actual tank based on the evaporation loss for this tank (See Japanese Patent Application Laid-Open Nos. 1-254959 and 1-254960).

According to this, since data corresponding to the actual evaporation loss can be obtained, its reliability can be actually improved.

However, in the above-described water adding system, since the monitoring tank is necessary independently of the actual treating tank, the entire apparatus becomes bulky while the number of parts required for it is also increased. In addition, the management and maintenance becomes complicated in order to set a working condition similar to that of the actual treating tank.

In view of the above-described circumstances, it is an object of the present invention to achieve an apparatus for treating the photosensitive material and a method of adding water for use in the same, in which an equipment such as the monitoring tank for evaluating the evaporation loss may be eliminated from the apparatus itself and a reliable and appropriate amount of water to be added may be evaluated while its manageability and maintainability can also be improved.

SUMMARY OF THE INVENTION

The apparatus for treating the photosensitive material according to the present invention comprises:

a treating solution tank storing a treating solution for treating the photosensitive material; and a sensor disposed at a position, which exhibits a different thermal conductivity depending on whether the treating solution is overflowing out of the treating solution tank or not, for sensing the presence of the overflow in accordance with the difference of the thermal conductivity.

According to the above-described arrangement of the present invention, the overflow of the treating solution, which is stored within the treating solution tank, may be sensed by the sensor for sensing the overflow. In consequence, the solution may be replenished or water may be added at least until the treating solution within the treating solution tank overflows to thereby sense the overflow by the overflow sensor so that a decrease of the surface level of the treating solution tank, that is, the evaporation loss may be evaluated.

As described above, since the concentration sensor or the surface level sensor, such as the float or the like, is not used, no error detection, as described above, can take place and a precise evaporation loss can be evaluated to add water without any excess or shortage and yet without environmental effects, such as temperature or humidity, because the evaporation loss can be evaluated by sensing the overflow.

Although, in general, the treating solution is known to precipitate and cover the surface of the sensor, since the sensor, which is disposed so as to sense the overflowing treating solution, is washed by the overflowing treating solution, it is difficult for the solution to precipitate thereon. Also from this point of view, it becomes possible to sense the precise amount.

In addiction, if a self-heat evolving temperature sensor is used as the overflow sensor, the overflow can be precisely sensed as compared with merely sensing the temperature of the overflowing solution with an ordinary temperature sensor. That is, since the self-heat evolving temperature sensor senses the presence or absence of the treating solution by sensing the difference in the thermal conductivity which prevails around the sensor, the presence or absence of the treating solution can be sensed practically independently of the temperature of the treating solution and its sensitivity is greatly improved while the error operation is eliminated and a reliable detection is achieved. In addition, without undergoing the effect caused by the ambient temperature, a precise change of temperature can always be sensed and it can be precisely sensed whether the overflow of the treating solution is present or not. In addition, the self-heat evolving sensor is also excellent from the standpoint of avoiding the problem of precipitation and a high sensitivity can be held over a long period of time.

This sensor may be disposed so that the overflowing solution adheres directly thereto or, instead, may be disposed within an environment where the thermal conductivity may vary with the overflowing treating solution.

In one embodiment of the invention, the apparatus may further comprises a replenishing means for replenishing the solution into the treating solution tank, a water adding means for adding water into the treating solution tank and a control means for controlling the operation of either one of the replenishing means and the water adding means, based on the selection of the overflow of the treating solution, by the self-heat evolving sensor, the control means controlling the operation of replenishing means so that a predetermined amount of the replenishing solution may be intermittently added into the treating solution tank by a constant amount while evaluating and amount of the solution added until it overflows, based on the detection of the overflowing treating solution by the sensor, which is caused by replenishment of the solution by the replenishing means, and controlling the operation of the water adding means so that an amount of water corresponding to the evaluated amount of the solution added may be supplied to the treating solution tank.

In such an arrangement, a predetermined amount of solution is intermittently supplied to the treating solution tank by a constant amount by the replenishing means, which is under the control of the control means. When the treating solution overflows due to this supply of the solution, this overflow may be sensed by the self-heat evolving temperature sensor. In accordance with an overflow signal from the sensor, an amount of the solution, which has been supplied into the treating solution tank until it overflows, is evaluated by the control means, and an amount of water corresponding to the evaluated amount is added by the water adding means, which is under the control of the control means. Such a relationship between the amount of the solution added until it overflows and the corresponding amount of water to be added can be previously set. The control means may be provided with a map representing this relationship. In addition, the above described amount of the solution may be previously set according to the throughput of the photosensitive material treated until the replenishing is initiated. In addition, the solution is intermittently supplied into the treating solution tank by a constant amount, the entire amount of the solution added until the overflow takes place may be evaluated by adding the constant amounts of the solution until the moment the overflow was sensed, that is, by multiplying the constant amount by the operating times of the replenishing means counted so far.

As a result, as compared with a case where the solution is continuously added into the treating tank, the entire amount of the solution added until the overflow takes place can be reliably and precisely evaluated.

Further, if a guide portion such as a notch or the like is provided at the upper end of the treating solution tank so that the overflow may take place through this guide portion, then the overflowing portion can be specified and it also becomes easy to specify the position where the self-heat evolving sensor is disposed.

Besides, the overflow may be introduced from the treating tank by means of a communicating line or the like to thereby specify the overflowing position to simplify positioning of the self-heat evolving sensor.

Next, if the amount of the treating solution to be withdrawn into the subject treating solution tank from the preceding tank by the photosensitive material equals that of the solution to be withdrawn from the subject treating tank into the following tank by the photosensitive material, then water may be added prior to replenishing the solution. In this case, the water adding means, which is under the control of the control means, intermittently supplies water by the constant amount and, upon detection of the overflow by the sensor, the control means may stop the operation of the water adding means. With this arrangement, unnecessary water cannot be added.

In addition, an annunciating means such as an alarm for issuing an alarm or an indicator lamp or the like may be provided so that when neither of the replenishing means and the water adding means are actuated, upon detection of the overflow by the self-heat evolving sensor, the annunciating means may recognize contamination (inclusion of different kinds of solution) caused by a vibration such as an earthquake or the like, which can be known by treating a control negative or the like, to thereby prevent mistreatment of the photosensitive material.

In addition, the present invention relates to a method of adding water, in which a solution is added into a treating solution tank storing a treating solution for treating the photosensitive material while an evaporation loss from the treating solution tank is compensated with water to hold the concentration of the treating solution constant comprising:

a first step in which a predetermined amount of solution is intermittently added into the treating tank divided by a constant amount;

a second step in which an overflow of the treating solution is sensed to evaluate an amount of the solution added into the treating tank until it overflows; and a third step in which, based on the amount of the solution added evaluated in the second step, the evaporation loss is evaluated to add water into the treating tank.

In the water adding method as described above, in the first step, the solution is intermittently added by a constant amount, and in the second step, when the treating solution within the treating solution tank overflows by this intermittent replenishment, this overflow is sensed to evaluate the entire amount replenished until the overflow takes place, In the third step, from this entire amount replenished, an evaporation loss corresponding thereto is evaluated to be added with water. As described above, since the solution is added intermittently by a constant amount, the entire amount of the solution replenished until the overflow takes place can be simply and precisely evaluated by integrating the replenishing times and the constant amount. Since the evaporation loss can be evaluated based on this entire amount of the solution replenished, a precise amount of water can be added as compared with a case where a predetermined amount of water is merely continuously replenished. In this case, each time the constant amount of the solution is added, it may be determined whether the overflow is present or not.

In addition, a map may be previously obtained revealing the relationship between the entire amount of the solution replenished until the overflow takes place and the corresponding evaporation loss, from which the evaporation loss may be evaluated.

Next, one embodiment of the invention may comprises:

a first step in which water is intermittently added into the treating tank by a constant amount;

a second step in which each time the constant amount of water has been added it is determined whether the overflow of the treating solution out of the treating tank is present or not and, upon detection of the overflow, the adding of water is stopped.

In that case, since, in the first step, the treating tank is intermittently added with water by the constant amount, and in the second step, each time water is added, the overflow is determined to be present or not, and upon detection of the same, the adding of water is stopped, the excessive addition of water, which causes the concentration of the treating solution to fall below a predetermined range, can be prevented.

As described above, according to the apparatus and the method of the present invention, an equipment for evaluating the evaporation loss may be eliminated from the apparatus itself and a highly reliable and precise amount of water to be added can be obtained while its manageability and maintainability can be improved.

BRIEF DESCRIPTION OF THE DRAWINGS

The present invention will now be hereinafter described in greater detail with specific reference to the accompanying drawings in which.

DESCRIPTION OF THE PREFERRED EMBODIMENT

Figure 1:
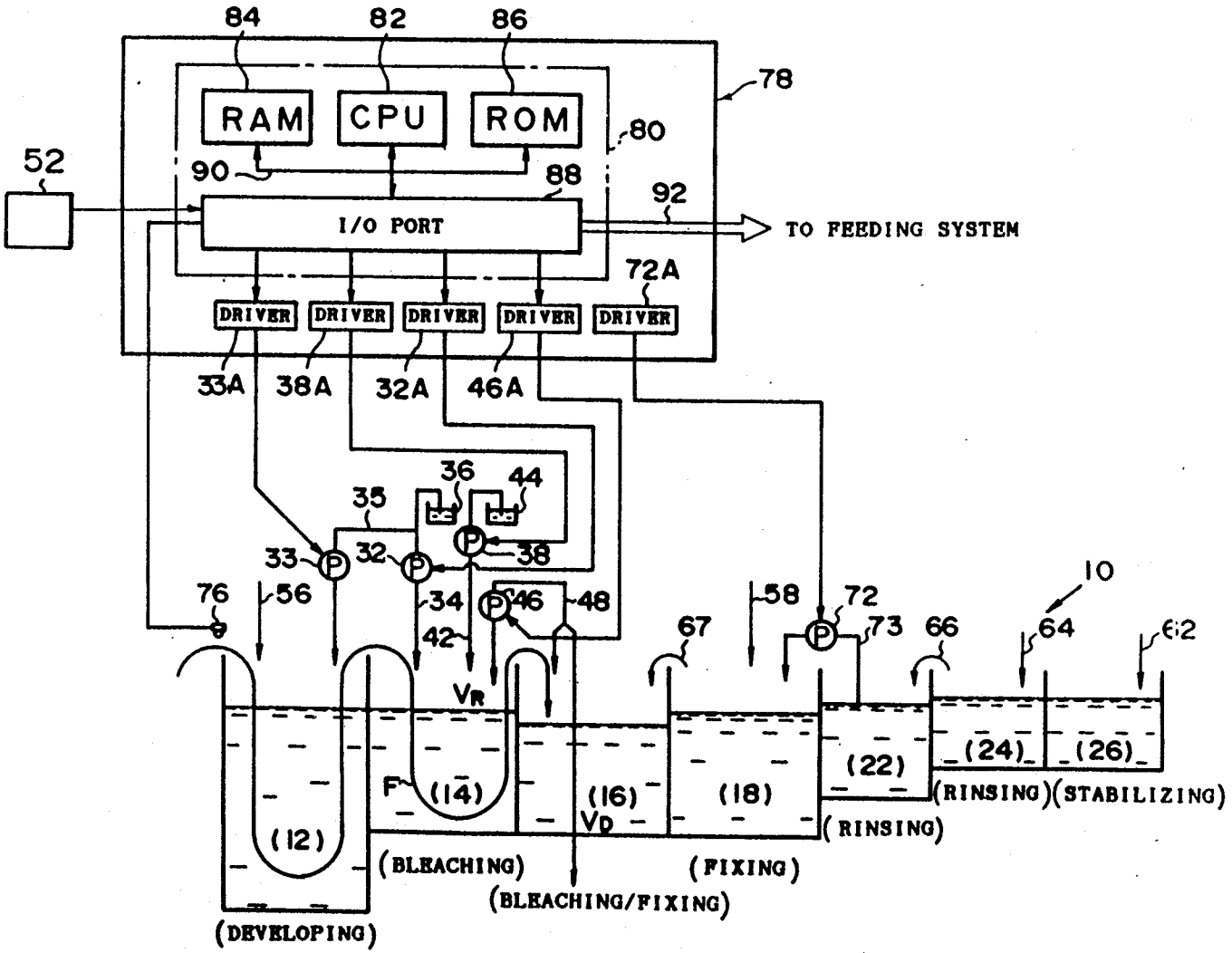
FIG. 1 is a schematic cross-sectional view illustrating an automatic developing machine embodying the present invention.

In FIG. 1, an automatic developing machine is illustrated as an apparatus for treating the photosensitive material according to the present invention, in which a developing tank 12, a bleaching tank 14, a bleaching-/fixing tank 16, a fixing tank 18, rinsing tanks 22, 24 and a stabilizing tank 26 are disposed in series each storing a developing solution, a bleaching solution, bleach/fixing solution, a fixing solution, a rinsing solution and a stabilizing solution respectively by a predetermined amount. A photosensitive material F is sequentially conveyed to these treating tanks by a feeding system (not shown)-(hereinafter generally referred to as the treating tank 10). This feeding system is controlled by a control unit 78, to which a signal line for a sensor 76 disposed at the inlet of the developing tank 12 for sensing passage of the photosensitive material F is connected so that the control unit 78 may recognize whether the photosensitive material F is present or not.

As shown in FIG. 1, disposed adjacent to the treating tank 10 is a water tank 36, which is in communication with the bleaching tank 14 via a line 34. Interposed at the intermediate portion of the line 34 is a pump 32 driven and controlled by the control unit 78, by which water may be supplied into the bleaching tank 14. In addition, disposed adjacent to the water tank 36 is a tank 44 for replenishing the solution, which is in communication with the bleaching tank 14 via the line 42.

Interposed at the intermediate portion of this line 42 is a pump 38 driven and controlled by the control unit 78 and, as in the above-described water supply system, the bleaching solution may be added into the bleaching tank 14 by driving of the pump 38.

Incidentally, at the line 34 for replenishing water into the bleaching tank 14, a branch line 5 is provided upstream of the pump 32. This branch line 35 extends toward the developing tank 12. Interposed at the intermediate portion of the branch line 35 is a pump 33 driven and controlled by the control unit 78 so that, by driving of the pump 33, water may be supplied into the developing tank 12.

At the treating tank 12, fixing tank 18 and stabilizing tank 26, which are the treating tanks other than the bleaching tank 14, lines 56, 58 and 62 are each provided for supplying the solution. In addition, a water supply line 64 is disposed at the rinsing tank 24 for supplying the rinsing water. From the rinsing tank 24, rinsing water is fed to the rinsing tank 22 by means of an overflow 66 while, from the bleaching tank 18, fixing solution may be fed to the bleaching/fixing tank 16 by means of an overflow 67. Rinsing water within the rinsing tank 22 is fed to the fixing tank 18 through the pump 72 and the line 73. Incidentally, driving of these pumps is also controlled by the above-described control unit 78.

Figure 2A:
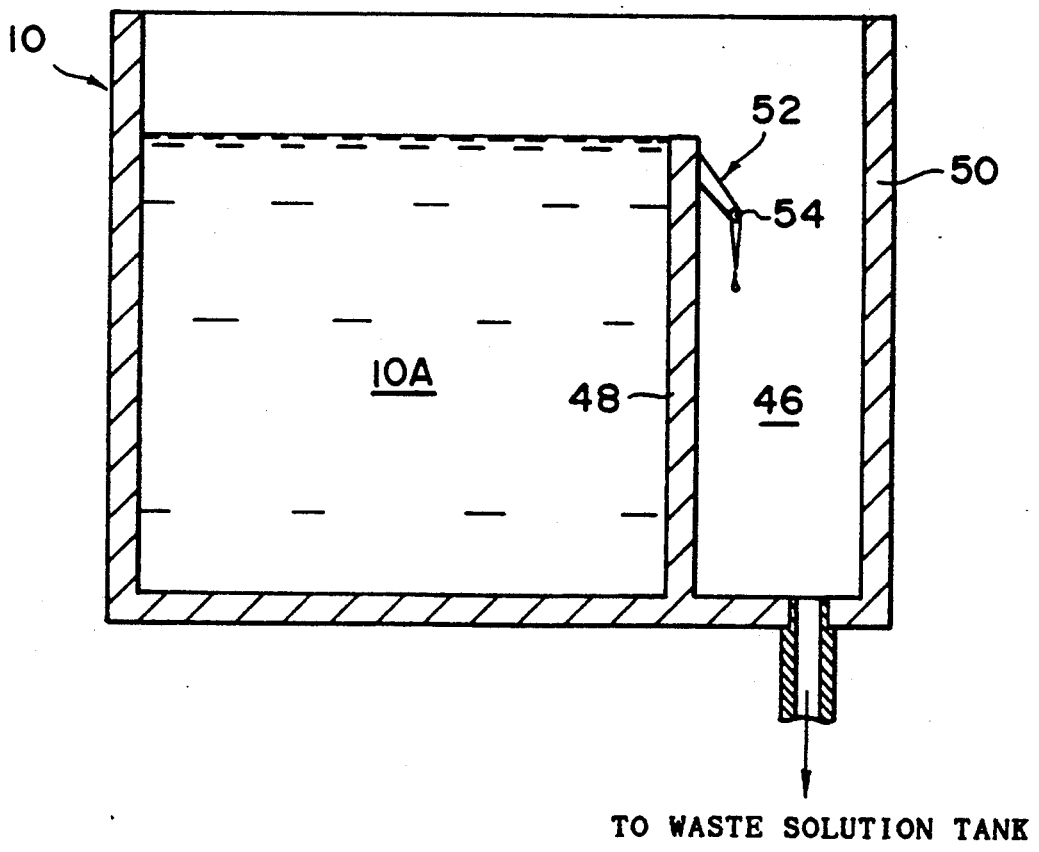
FIG. 2A is an enlarged view illustrating a portion around an overflow tank.

As shown in FIG. 2A, each treating tank 10 is provided with a treating solution tank 10A storing each treating solution and an overflow tank 46 adjacent to this treating solution tank 10A, which are partitioned with a vertical wall 48 disposed therebetween. The height of the vertical wall 48 is set lower than a lateral wall 50 of the treating tank 10 and, beyond this wall 48, the treating solution within the treating solution tank 10A flows out toward an overflow tank 46.

Within this overflow tank 46, a self-heat evolving sensor 52 is disposed. The profile of the sensor 52 is bar-shaped and is covered with a teflon series resin while disposed along the streamline of the treating solution running toward the overflow tank 46 so as to contact the treating solution overflowing out of the treating solution tank 10A. A sensor portion 54 is disposed at the intermediate portion, as viewed in the longitudinal direction thereof. The sensor portion 54 is formed of a thermistor chip covered with a glass tube.

With this self-heat evolving sensor 52, the sensor portion 54 constantly evolves heat of 150° C. to 200° C. by a control circuit (not shown), and senses the difference in the thermal conductivity, which prevails around the sensor portion 54, from the treating solution which drops along the bar-shaped portion causes the temperature of the heat evolving at the sensor 54 to change to sense whether the treating solution is present or not. As this self-heat evolving temperature sensor 52, a hot thermistor (commercially available from Shibaura Denki Seisakusho, Inc. under the same trademark) is applicable. In addition, those types which evolve heat due to the action of current to change the resistance, such as a ceramic heater having a platinum resistance or tungsten pattern, may also be used as the sensor for the present invention. Incidentally, the sensor 52 is connected to the control unit 78.

As shown in FIG. 1, the control unit 78 is arranged including a microcomputer 80, which comprises a CPU 82, an I/O port and buses 90 such as data buses or control buses or the like for connecting these. Connected to the I/O port 88 are the above-described pumps 32, 33, 38, 46 and 72 via drivers 32A, 33A, 38A, 46A and 72A respectively. In addition, also connected to this I/O port 88 are a sensor 88 and a self-heat evolving temperature sensor 52. In addition, also connected to this I/O port 88 is a signal line 92 leading to the feeding system.

Figure 4:
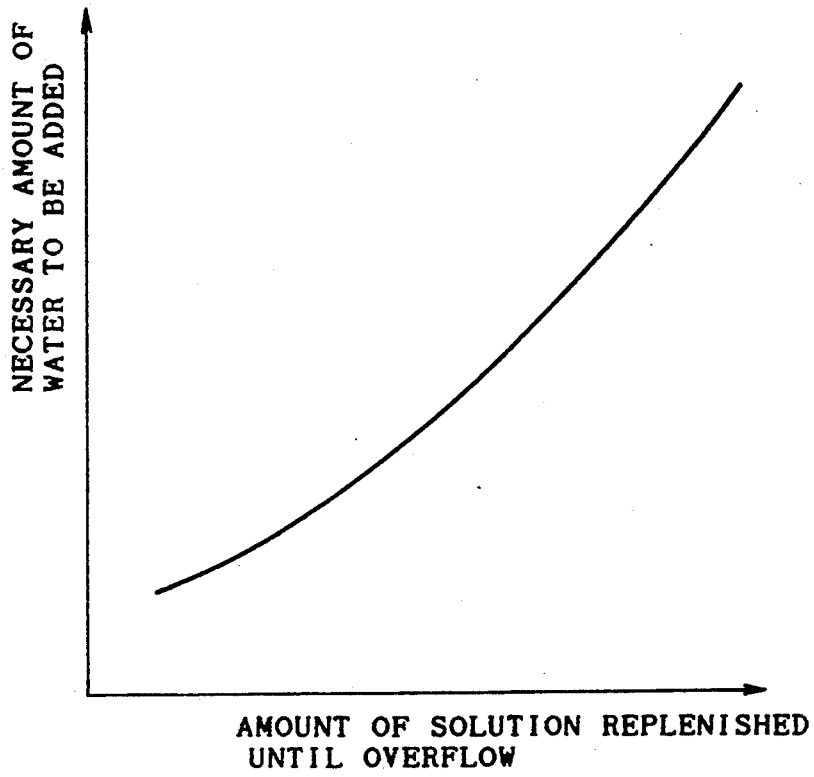
FIG. 4 is a map revealing a relationship between the entire amount of the solution replenished until the treating solution overflows out of the treating solution tank and the corresponding amount of water to be added.

Within a RAM 84 of the microcomputer 80, as shown in FIG. 4, a map revealing a relationship between the entire amount of the solution added until it overflows out of the treating solution tank 10A and the corresponding amount of water to be added is stored. By this entire amount of the solution added (actual amount of the solution stored) is meant an actual amount of the solution added into the treating tank: a predetermined amount of the solution to be fed (for example, 150 ml) is intermittently replenished by a constant amount (for example, 10 ml) and it is determined for each time interval whether the overflow is present or not.

Figure 3:
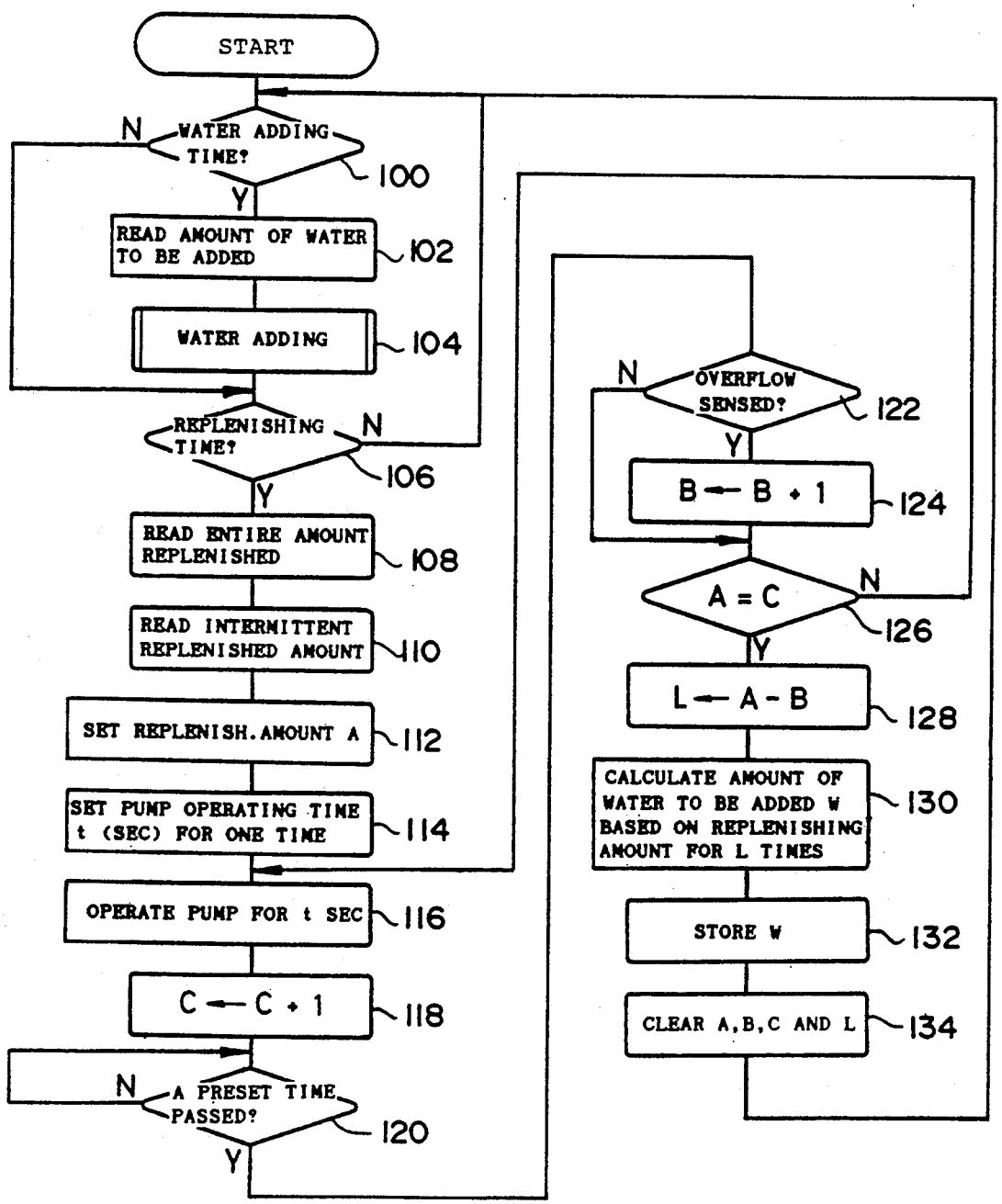
FIG. 3 is a flowchart illustrating a routine for controlling addition of water.

In addition, within a ROM 86 of the microcomputer 80, a program for replenishing the solution and a program for controlling addition of water, as shown in FIG. 3 are stored.

Next, the operation of this embodiment is hereinafter described with reference to a control flowchart of FIG. 3.

The photosensitive material F is sequentially introduced from the bleaching tank 14 into the bleaching-/fixing tank 16 where it is subjected to the treatments such as developing, bleaching and the like and, after withdrawn out of the stabilizing tank 26, it is dried.

In step 100, it is determined whether the time for adding water is due or not, and if it is determined that the time is due as when the operation is being initiated in the morning, then the routine is shifted to step 102 to read out an amount of water to be added W which is stored within RAM 84 of the control unit 78. This amount W is set in accordance with the amount of the solution added and is later described.

When, in step 102, the amount W is read out, the routine is shifted to step 104 where after a predetermined pump is actuated and water is added into the treating solution tank 10A of a predetermined tank 10, the routine is shifted to step 105. On the contrary, if otherwise determined, the procedure skips steps 102 and 104 to shift to step 106.

In step 106, it is determined whether the time for adding the solution is due or not. It is determined that the time is due if the throughput of the photosensitive material F calculated by the control unit 78 in accordance with the signal from the sensor 76, which senses the presence of the photosensitive material F, adds up to, for example, 50 in terms of the negative film. In this case, if the answer is determined no, procedure is shifted to step 100.

If, in step 105, the answer is determined yes, that is, t is determined that the time for adding the solution is due, then the procedure is shifted to step 108 where a preset entire amount of the solution to be added (a predetermined value) is read out and, in step 110, this amount is divided to read out an amount of the solution to be intermittently added. In this embodiment, the entire amount of the solution to be added is 150 ml while the amount of the solution to be intermittently added is 10 ml. In the next step 112, times of adding the solution intermittently is set and then, in step 114, after the pump operating time t for a single time is set, the procedure is shifted to step 116.

In step 116, the pump is operated for t second(s) to replenish a fractional amount and the procedure is shifted to step 118. In step 118, a counter C for counting the replenishing times is incremented and then the procedure is shifted to step 120, where it is determined whether a predetermined period of time has passed or not. This treating time corresponds to a time that is taken from the moment the pump starts to operate up to the moment the treating solution within the treating tank 10 actually overflows.

If, in step 120, it is determined that a predetermined period of time has passed, then the procedure is shifted to step 122 where it is determined whether the overflow was sensed or not by the self-heat evolving temperature sensor 52, and if yes, the sensing times B are incremented and the procedure is shifted to step 124 while, on the contrary, if no, the procedure is directly shifted to step 124.

In step 124, it is determined whether the actual replenishing times have added up to the predetermined replenishing times A or not, and if no, the procedure is shifted to step 116 for repetition of the above-described affirmative judgments. On the contrary, if yes, then the procedure is shifted from step 124 to step 126 where a replenishing time L is calculated by subtracting the overflow sensing times B from the predetermined replenishing times A. Then, in step 128, based on the replenished amount for this replenishing time L, that is, the actual amount stored into the treating tank 10, an amount of water to be added is calculated from the map of FIG. 4, and after, in step 130, this amount W is stored into RAM 84, the procedure is shifted to step 132, where values A, B, C and L as for the replenishing time and the like are cleared and the procedure is shifted to step 100.

According to this embodiment, since the self-heat evolving temperature sensor 52 is used in order to sense the overflow, no error action occurs as is the case with the use of a float or the like, which can cause the same due to its mechanical movement. In addition, since the sensor evolves its own heat, the error action can be prevented which results from other factors causing a temperature change, such as atmospheric temperature or precipitation or the like, as is the case with the mere use of the temperature sensor such as thermocouple or the like, with the result that the overflow can be precisely and reliably sensed.

Figure 5:
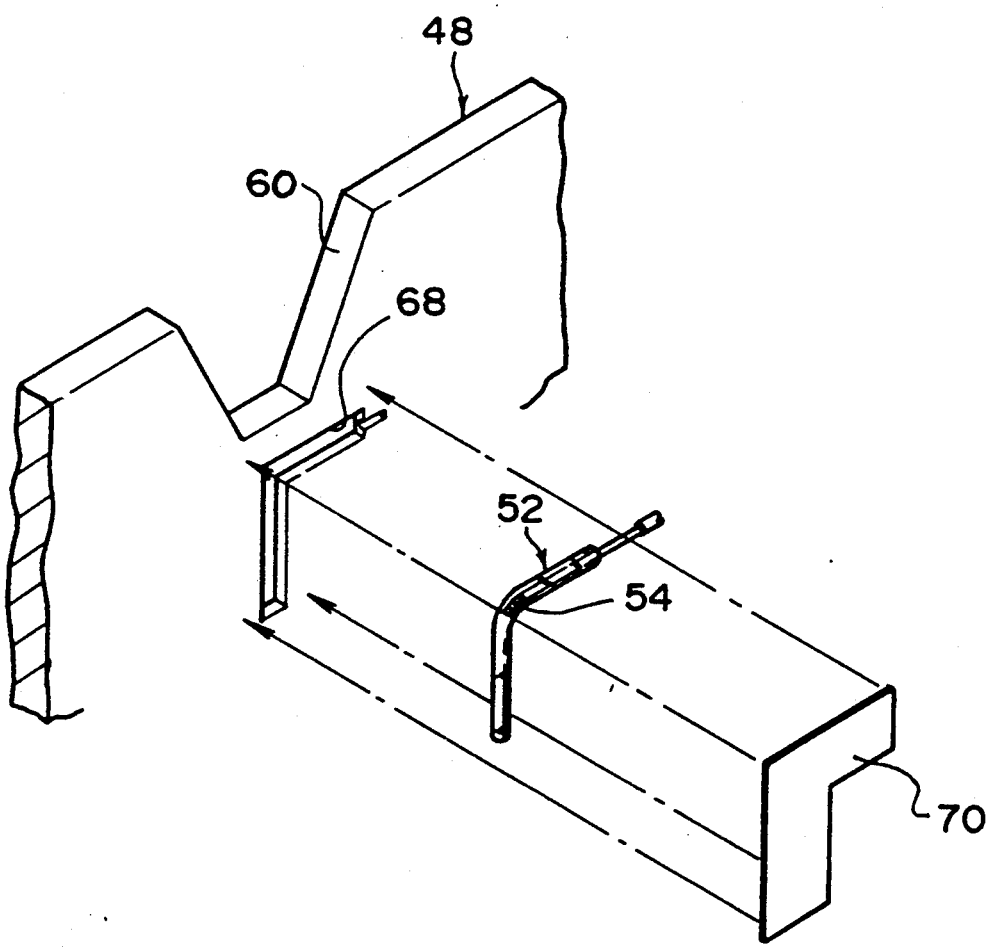
FIG. 5 is an exploded perspective view illustrating a modified example of a position where a self-heat evolving temperature sensor is attached.

Incidentally, although, in this embodiment, the self-heat evolving temperature sensor 52 may be provided exposed at a portion of the overflow tank where the treating solution actually flows, as shown in FIG. 5, a substantially V-shaped notched portion 60 is provided on the vertical wall 48 so as to collect the flow of the treating solution while, below this notched portion 60, a groove portion 68 which coincides substantially with the profile of the sensor 52 may be provided so as to embed the sensor 52 therein. The groove portion 68 may be sealed with a cover 70.

Figure 2B:
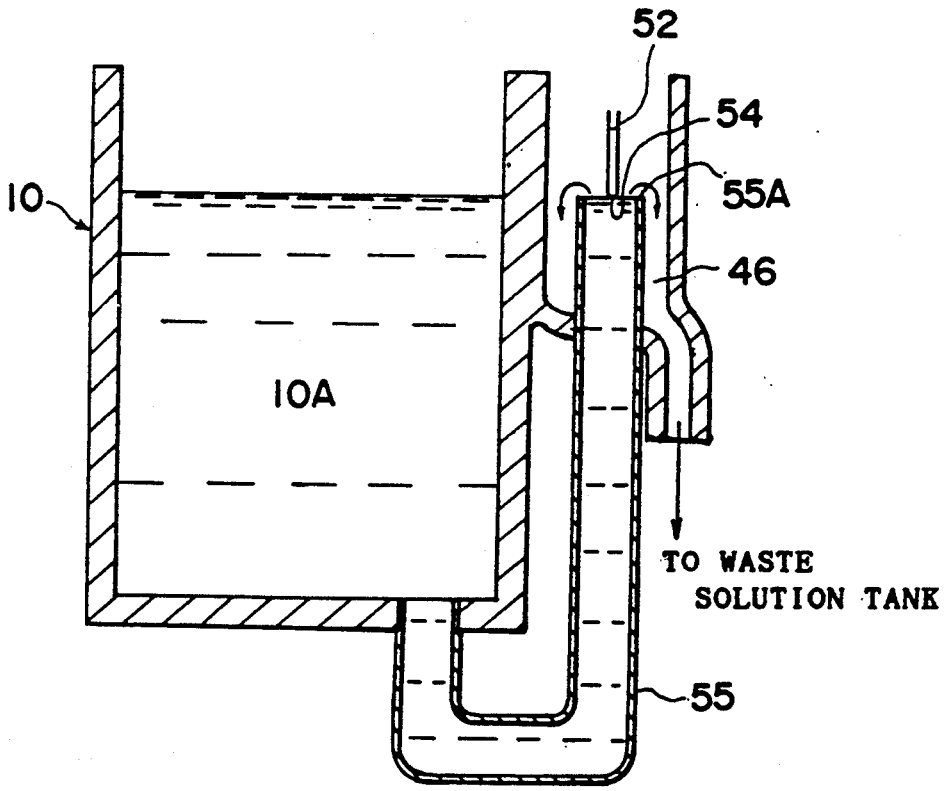
FIG. 2B is a modified embodiment illustrating a portion surrounding the overflow tank.

As a modified embodiment, as shown in FIG. 2B, a communicating line 55 which communicates with the treating solution tank 10A may be provided. This communicating line 55 is in communication with the bottom portion of the treating solution tank 10A at its end, and its other end is positioned within the overflow tank 46 while forming an open-ended portion 55A, which is open at the same position as the highest level of the treating solution of the treating solution tank 10A. The self-heat evolving sensor 52 is disposed so that its sensor portion 54 may be positioned at the end surface of the open-ended portion 55A. In consequence, when the treating solution overflows out of the open-ended portion 55A, it once stands up above the rim of the open-ended portion 55A under the action of the surface tension before it overflows. At this time, the overflow is sensed by the sensor 52. Incidentally, one end of the communicating line may be communicated with the later portion of the treating solution tank, or the sensor portion 54 of the sensor 52 may be positioned at the outside of the communicating line 55 so that is may contact the treating solution overflowing out of the open-ended portion 55A.

In addition, in this embodiment, when the solution is replenished, it is determined whether the overflow is present or not, and the entire amount of the solution replenished until the overflow is sensed is evaluated and the amount of water to be added, which corresponds to the entire amount is read out from the map stored within RAM 84 to add water by this amount. However, if the amount of the treating solution which is brought into the treating solution tank by the photosensitive material itself may be regarded as being substantially equal that of the treating solution brought out of the treating solution tank by the photosensitive material, then a reduced surface level of the treating solution tank can be regarded as caused by the evaporation loss. In consequence, in this case, water may be previously added and thereafter a predetermined amount of the solution may be replenished. If water is intermittently added by a predetermined amount, the overflow is sensed using the self-heat evolving temperature sensor and upon detection of the overflow water addition stopping then the unnecessary addition of water may be prevented.

Figure 6:
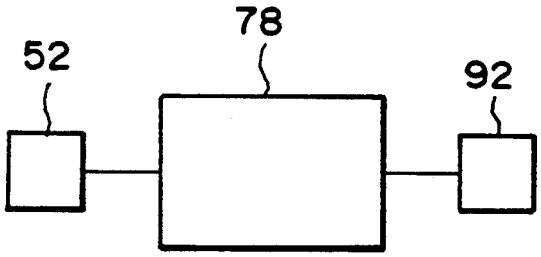
FIG. 6 is a modified example of the apparatus in which an alarm unit is provided.

In addition, this sensor may determine whether the overflow has taken place or not during the normal operating or shutdown time of the apparatus if it is made to operate regardless of whether water is added or not. In this case, as shown in FIG. 6, when neither of the replenishing of the solution nor water adding is being carried out, if the occurrence of the overflow has been sensed, the control unit 78 may emit a signal to an alarm unit 96, which in turn issues an alarm. Thus it could be determined that, during the operating or shutdown time, the solution overflows into the overflow tank 46 due to the vibration of the apparatus caused by an earthquake or the like, and the subsequent amount of the solution to be replenished or the amount of water to be added may be corrected. In addition, in place of the alarm unit 96, or together with the alarm unit 96, the occurrence of the overflow under the abnormal conditions may be announced by means of the lamp or the like.

What is claimed is:

1. Apparatus for treating a photosensitive material comprising:

a treating solution tank storing a treating solution for treating a photosensitive material; and a sensor disposed at a position which exhibits a different thermal conductivity depending on whether the treating solution is overflowing out of the treating solution tank or not, for sensing the overflow of the treating solution based on said difference in the thermal conductivity.

2. Apparatus as set forth in claim 1 wherein said overflow sensor is a self-heat evolving temperature sensor.

3. Apparatus as set forth in claim 2 wherein said self-heat evolving temperature sensor is disposed at a position where it contacts the overflowing treating solution.

4. Apparatus as set forth in claim 2 wherein said self-heat evolving temperature sensor is disposed at a position where it does not contact the overflowing treating solution.

5. Apparatus as set forth in claim 2 further comprising:

a means for replenishing the solution into said treating solution tank;

a means for adding water into said treating solution tank; and a means for controlling the operation of either one of said replenishing means and said water adding means based on the overflow of said treating solution sensed by said sensor.

6. Apparatus as set forth in claim 5 wherein said control means controls the operation of said replenishing means so that a predetermined amount of said solution may be intermittently replenished into said treating solution tank by a constant amount while evaluating an amount of the solution replenished until it overflows, based on the overflow of said treating solution sensed by said sensor, which is caused by replenishing of the solution by said replenishing means and controlling the operation of said water adding means so that an amount of water corresponding to said evaluated amount of the solution replenished may be supplied into said treating solution tank.

7. Apparatus as set forth in claim 6 wherein said control means is provided with a map revealing a relationship between the amount of the solution replenished until it overflows and the corresponding amount of water to be added into said treating solution tank.

8. Apparatus as set forth in claim 2 wherein said treating solution tank is provided with a guide portion so as to direct the overflow of the solution to a predetermined position.

9. Apparatus as set forth in claim 8 wherein said guide portion comprises a notch provided at the upper end of a wall of said treating solution tank.

10. Apparatus asset forth in claim 2 wherein said treating solution tank is provided with a line for introducing the solution, which is communication therewith and said overflow occurs at the opening off said line.

11. Apparatus as set forth in claim 5 further comprising an annunciating means for annunciating the detection of the overflow of the treating solution by said sensor when said replenishing means and said water adding means are not operating.

12. Apparatus as set forth in claim 5 wherein said control means controls the operation of said water adding means so that water may be intermittently supplied into said treating solution tank by a constant amount until the treating solution overflows out of said treating solution tank while said supply of water may be stopped at the moment said overflow is sensed by said sensor and then controls the operation of said replenishing means so that a predetermined amount of the solution may be replenished into said treating solution tank.

13. A method of adding water for use in an apparatus for treating a photosensitive material, wherein a solution is replenished into a treating solution tank, which stores a treating solution for treating the photosensitive material, while an evaporation loss from said treating solution tank is compensated with water, to hold the concentration of the treating solution within said treating solution tank constant, comprising the steps of:

a) intermittently replenishing a predetermined and constant amount of solution into said treating solution tank until the treating solution overflows said treating solution tank;

b) sensing when the overflow of the treating solution occurs to thereby determine a total amount of the solution replenished into said treating solution tank up until the overflow occurs;

c) determining said evaporation loss, based on the total amount of the solution replenished as determined in step b; and d) compensating for said evaporation loss as determined in step c, by adding water to said treating solution tank.

14. The method of adding water as set forth in claim 13 wherein, in said step b, each time said constant amount has been replenished, determining whether the overflow of the treating solution has taken place or not.

15. The method of adding water as set forth in claim 14 wherein said amount of the solution replenished until it overflows equals an entire amount of the solution replenished before the overflow is determined to have taken place.

16. The method of adding water as set forth in claim 15 wherein said step c further comprises determining said evaporation loss based on a previously obtained relationship between the total amount of the solution replenished and a corresponding evaporation loss.

17. The method of adding water as set forth in claim 13 wherein, in said step, b said detection of the overflow is achieved through the difference in the thermal conductivity of the surrounding environment as observed while the overflow is taking place and while the overflow is not taking place.

18. A method of adding water for use in an apparatus for treating a photosensitive material, wherein a solution is replenished into a treating solution tank, which stores a treating solution for treating the photosensitive material, while an evaporation loss from said treating solution tank is compensated with water, to hold the concentration of the treating solution within said treating solution tank constant, comprising the steps of:

a) intermittently adding a constant amount of water to said treating solution tank;

b) determining, each time said constant amount of water has been added, whether an overflow of said treating solution out of said treating solution tank has taken place; and c) stopping the addition of said water at the moment the overflow of said treating solution has been determined.

19. The method of adding water as set forth in claim 18, wherein said determination of the overflow is achieved through the difference in the thermal conductivity of the surrounding environment as observed while the overflow is taking place and while the overflow is not taking place.

* * * * *